US005333344A

United States Patent [19]

Frieb

[11] Patent Number: 5,333,344

[45] Date of Patent: Aug. 2, 1994

[54] JAW-TYPE HOLDER FOR CLEANING TOOL

[75] Inventor: Viktor Frieb, Vienna, Austria

[73] Assignee: Eduard Frieb Gesellschaft m.b.H, Vienna, Austria

[21] Appl. No.: 996,717

[22] Filed: Dec. 24, 1992

[30] Foreign Application Priority Data

Feb. 11, 1992 [AT] Austria ..... A 229/92

[51] Int. Cl.[5] ..... B25G 3/24

[52] U.S. Cl. ..... 15/146; 15/145

[58] Field of Search ..... 15/146, 145, 147.1, 15/150, 176.1, 244.1; 248/225.31, 231.3, 231.5

[56] References Cited

U.S. PATENT DOCUMENTS

| | | | |
|---|---|---|---|
| 723,223 | 3/1903 | Bruhn | 15/146 |
| 1,441,067 | 1/1923 | Clickner | 15/146 |
| 1,478,213 | 12/1923 | Forisdal | 15/146 |
| 2,672,639 | 3/1954 | Bruger | 15/146 |
| 4,499,626 | 2/1985 | Schneider | 15/146 |

FOREIGN PATENT DOCUMENTS

| | | | |
|---|---|---|---|
| 240200 | 5/1965 | Austria | 248/231.5 |
| 97019 | 4/1898 | Fed. Rep. of Germany | 15/146 |
| 568427 | 1/1933 | Fed. Rep. of Germany | 15/146 |
| 1131276 | 10/1956 | France | 15/146 |
| 41082 | 3/1925 | Norway | 15/146 |
| 215124 | 5/1924 | United Kingdom . | |

*Primary Examiner*—Timothy F. Simone
*Assistant Examiner*—Patrice F. Brinson
*Attorney, Agent, or Firm*—Herbert Dubno; Andrew Wilford

[57] ABSTRACT

A holder for a cleaning device has a pair of jaws defining a holding space and displaceable between a retaining position relatively close to each other and restricting the space and a releasing position spaced apart relatively far from each other. The cleaning device can be moved into and out of the space when the jaws are in the releasing position but is snugly engaged and held by the jaws when in the space in the retaining position. The jaws are urged by spring force into the releasing position. A pin traversing the jaws has one end bearing on one of the jaws and an opposite end formed with an elongated crosspiece oppositely bearing on the other jaw. The crosspiece is movable between first and second angularly offset positions. Formations on the other jaw move the jaws from the releasing position into the retaining position on movement of the crosspiece from the first to the second position and move the jaws from the retaining position into the releasing position on movement of the crosspiece from the second to the first position.

6 Claims, 2 Drawing Sheets

JAW-TYPE HOLDER FOR CLEANING TOOL

FIELD OF THE INVENTION

The present invention relates to a jaw-type holder for a cleaning tool. More particularly this invention concerns a system for securing a cleaning tool such as a brush or mop head on the end of a pole or wand.

BACKGROUND OF THE INVENTION

Systems for securing a cleaning device must be made as simple as possible to manipulate without affecting their mechanical operation or service life. Since these are mass-produced items they must be simple and inexpensive to manufacture.

The known systems often are fairly complex, or require the user to carry out a series of steps to take the cleaning device out of the holder.

OBJECTS OF THE INVENTION

It is therefore an object of the present invention to provide an improved jaw-type holder for a cleaning tool.

Another object is the provision of such an improved jaw-type holder for a cleaning tool which overcomes the above-given disadvantages, that is which is easy to use and of simple and durable construction.

SUMMARY OF THE INVENTION

A holder for a cleaning device has according to the invention a pair of jaws defining a holding space and displaceable between a retaining position relatively close to each other and restricting the space and a releasing position spaced apart relatively far from each other. The cleaning device can be moved into and out of the space when the jaws are in the releasing position but is snugly engaged and held by the jaws when in the space in the retaining position. The jaws are urged by spring force into the releasing position. A pin traversing the jaws has one end bearing on one of the jaws and an opposite end formed with an elongated crosspiece oppositely bearing on the other jaw. The crosspiece is movable between first and second angularly offset positions. Formations on the other jaw move the jaws from the releasing position into the retaining position on movement of the crosspiece from the first to the second position and move the jaws from the retaining position into the releasing position on movement of the crosspiece from the second to the first position.

Thus this system is extremely simple to manufacture and use. It has only three significant parts—the two jaws and the bolt with its normally unitary crosspiece—so the likelihood of it breaking is minimized. According to the invention a tubular handle has an open end snugly receiving generally semicylindrical extensions formed on the jaws. The jaws are formed of a resiliently deformable material so that they themselves constitute the spring that urges them apart into the releasing position.

The other jaw according to the invention is formed with a retaining surface and is formed in the retaining surface with a crosswise recess. The crosspiece lies in the recess in the second position only and otherwise lies on the surface offset from the recess. A formation, for instance a notch, on the other jaw releasably retains the crosspiece in the first position.

The jaw is oriented in the first position at about 90° to its orientation in the second position. Thus a simple pivoting of the jaw through a right angle opens or closes the jaws.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
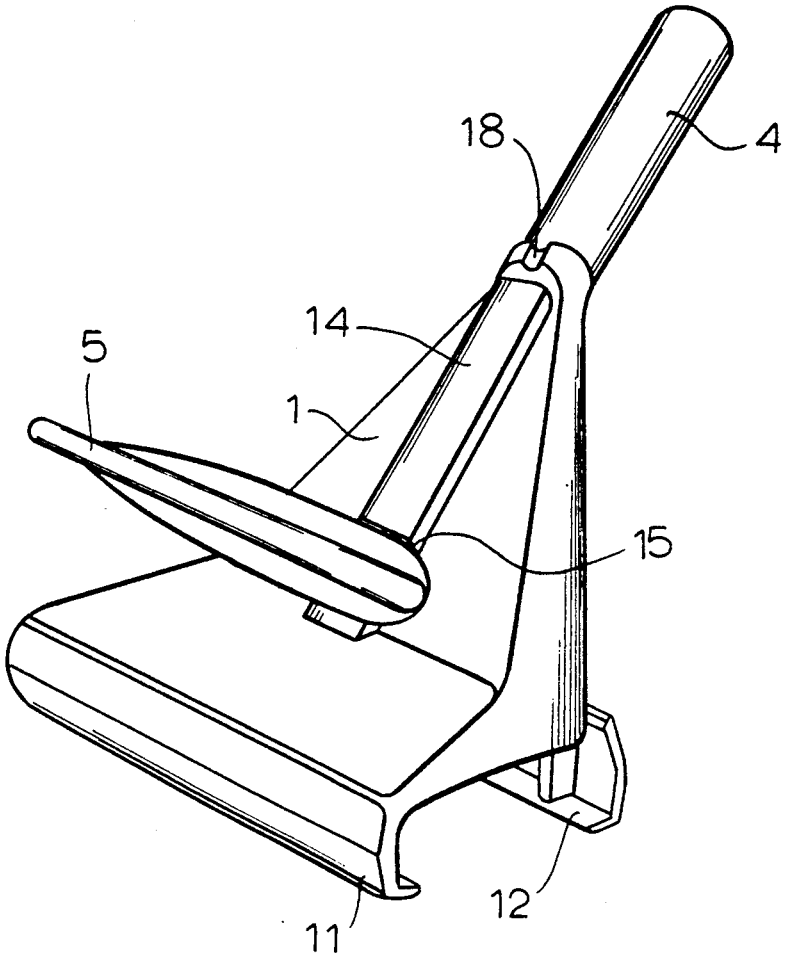
FIG. 1 is a perspective view of the holder according to the invention.

As seen in the drawing a cleaning-device holder consists of two parts 1 and 2 which are formed on their lower ends with jaws 11 and 12 by means of which a cleaning device, e.g. a brush 3, can be releasably held. The two parts 1 and 2 are formed on their upper ends with semicylindrical extensions 12 and 22 over which a tubular handle stick 4 is fitted. The shape of the two parts 1 and 2, which are of an elastically resilient material and in particular of a hard plastic, is selected such that they spring apart in their normal releasing illustrated in FIG. 1 position so that the brush 3 can be set into or removed from between them. In this case the intrinsic elasticity of the parts 1 and 2 constitutes the "spring means" of this invention that urges them into the FIG. 1 position.

The brush 3 is clamped between the two jaws 11 and 12 by an actuating element in the form of a pivotal arm 5 from which a pin 6 projects that traverses bores of the two parts 1 and 2. The arm 5 engages by means of a ring 61, which is fixed on the bolt 6, against the part 2. The part 1 is furthermore formed with a support surface 14 on which the pivotal arm 5 lies in a first position corresponding to the FIG. 2 retaining position of the holder. The support surface 14 is centrally formed with a recess 15 which subdivides the surface 14 into two sections and which extends nearly perpendicular to the support surface 14. The recess 15 receives the pivotal arm 5 in a second position as shown in FIG. 1.

Figure 2:
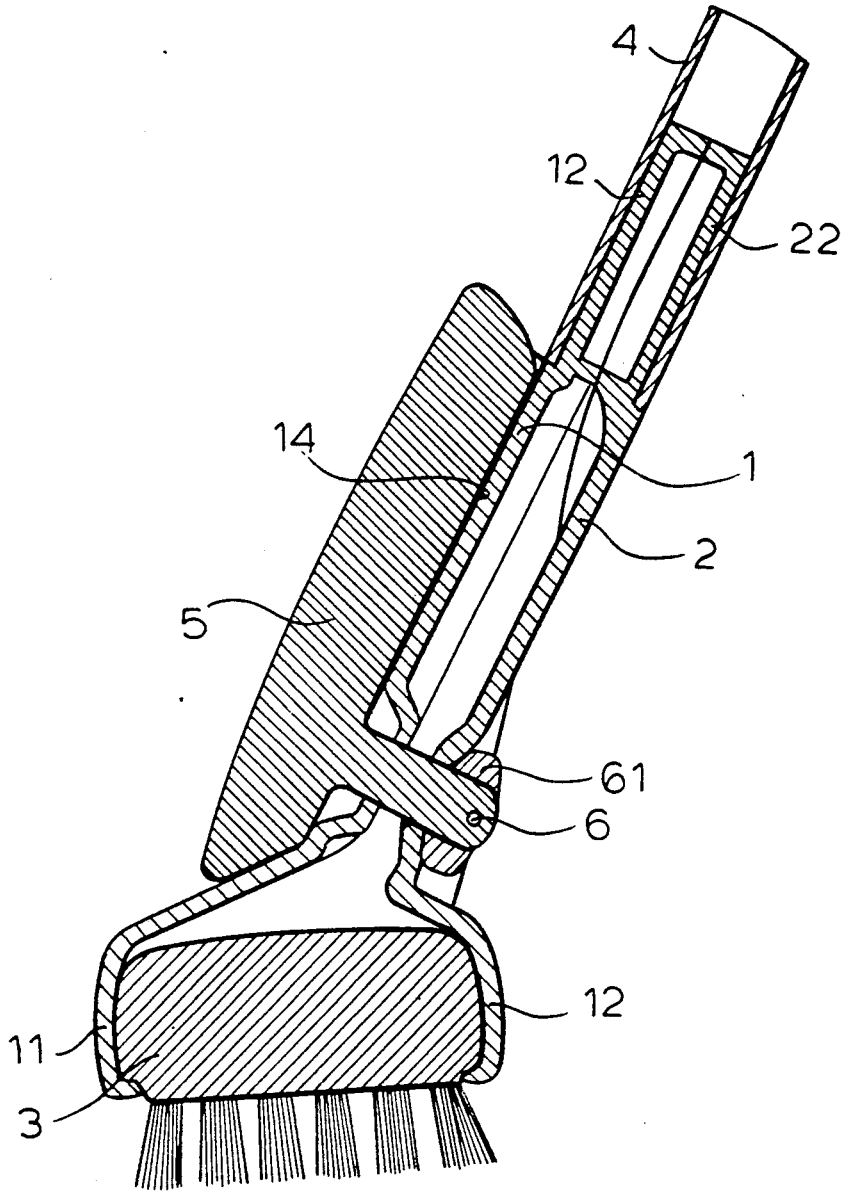
FIG. 2 is a longitudinal section through the holder while retaining a brush.

The operation of the system is as follows:

In the position of the pivotal arm 5 shown in FIG. 1 in which it is retained in the recess 15, the two parts 1 and 2 are separated by their inherent springiness so that the jaws 11 and 12 are at a considerable spacing from each other and a cleaning device, e.g. the brush 3, can be set between or taken out from between them. As soon as subsequently the pivotal arm 5 is swung through about 90° it rides up on the two sections of the support surface 14 so that the two jaws 11 and 12 are moved toward each other and a brush 3 set between them is clamped in the space between them thereby moving the jaws 11 and 12 between the FIG. 2 retaining position and the FIG. 1 releasing position. To fix the position of the pivotal arm in the retaining position there is a latching device which is formed by a groove or notch 18 formed in the part 1 and in which the upper part of the pivotal arm 5 engages.

Since a holder according to the invention is formed by a very small number of parts which are simply connected together, it is very inexpensive to manufacture. Since furthermore to use it a pivotal arm need only be set in two positions, it can be operated simply. In addition the construction is so simple that a long service life is ensured, and in any case damaged individual parts can be replaced at any time by new parts.

I claim:

1. A holder for a cleaning device, the holder comprising:

a pair of jaws defining a holding space and displaceable between a retaining position relatively close to each other and restricting the space and a releasing position spaced apart relatively far from each other, the jaws normally assuming the holding position and being elastically deformable into the releasing position, so that the cleaning device is movable into and out of the space when the jaws are in the releasing position and is snugly engaged by the jaws when in the space in the retaining position;

a pin traversing both of the jaws along a pin axis and rotatable about the pin axis, the pin having one end bearing axially in one direction on one of the jaws and an opposite end formed unitarily with an elongated crosspiece and bearing axially oppositely on the other jaw, the crosspiece being rotatably movable about the pin axis between first and second angularly offset positions, respectively corresponding to the releasing and retaining positions; and means including a retaining surface formed with a crosswise recess and with formations offset from the recess on the other jaw for, in cooperation with the pin and crosspiece, moving the jaws from the releasing position into the retaining position on movement of the crosspiece from the first to the second position and for moving the jaws from the retaining position into the releasing position on movement of the crosspiece from the second to the first position, the crosspiece lying in the recess in the first position corresponding to the releasing position of the jaws and being displaced from the recess upon displacement of the crosspiece out of the first position toward the second position and engaging the formations in the second position.

2. The cleaning-device holder defined in claim 1, further comprising a tubular handle having an open end, the jaws being formed with generally semicylindrical extensions snugly engaged in the handle open end.

3. The cleaning-device holder defined in claim 2 wherein the jaws are formed of a resiliently deformable material constituting the spring means.

4. The cleaning-device holder defined in claim 1 wherein the one end of the pin is provided with a ring bearing against the one jaw.

5. The cleaning-device holder defined in claim 1 wherein the formation is an outwardly open notch.

6. The cleaning-device holder defined in claim 1 wherein the jaw is oriented in the first position at about 90° to its orientation in the second position.

* * * * *